US005086635A

United States Patent [19]

Creaser et al.

[11] Patent Number: 5,086,635

[45] Date of Patent: Feb. 11, 1992

[54] METHOD OF AND MACHINE FOR FORMING COMPOUND CURVATURES IN METAL SHEETS BY DRAWING

[75] Inventors: Charles Creaser, Lady Lake, Fla.; Ray C. Johnson, Webster, N.Y.

[73] Assignee: Chu Associates, Inc., Littleton, Mass.

[21] Appl. No.: 624,982

[22] Filed: Dec. 10, 1990

[51] Int. Cl.[5] ..... B21D 5/06

[52] U.S. Cl. ..... 72/176; 72/307

[58] Field of Search ..... 72/176, 183, 160, 162, 72/307, 311, 305

[56] References Cited

U.S. PATENT DOCUMENTS

| | | | |
|---|---|---|---|
| 2,395,651 | 2/1946 | Anderson | 153/32 |
| 2,480,826 | 9/1949 | Anderson | 153/2 |
| 2,851,080 | 9/1958 | Anderson | 153/2 |
| 2,935,115 | 5/1960 | Anderson | 72/176 |
| 2,954,066 | 9/1960 | Anderson | 72/176 |
| 2,960,140 | 11/1960 | Anderson | 72/176 |
| 3,958,436 | 5/1976 | Anderson | 72/17 |

OTHER PUBLICATIONS

General Dynamics/Fort Worth Applied Manufacturing Research and Process Development Company for The United States Air Force, "Final Report on Effects of Androforming on Material Properties", published Nov. 1963, pp. 50–52.

*Primary Examiner*—Daniel C. Crane

*Attorney, Agent, or Firm*—Rines and Rines Shapiro and Shapiro

[57] ABSTRACT

An improved method of and apparatus for forming sheet material into compound curves by drawing, in which critical positioning, dimensioning and relative curvatures of forming bead stages are provided for such curvatures as sectors of paraboloidal antenna reflectors and other compound curve sheets.

10 Claims, 11 Drawing Sheets

STAGE I
STAGE II
STAGE III
$S_N$
$S_W$
S
B
T
$H_{12}$
$H_{23}$
1
2
3
4
5
7
9
10
11
12
13
14
15
16
17
18
19
20
23
24
25
26
30

JAWS RETRACTED

JAW CARRIAGE ADVANCE
STAGE II DOWN

JAW CARRIAGE STOPPED
JAW SLIDE
DRIVE STOPPED

T/

METHOD OF AND MACHINE FOR FORMING COMPOUND CURVATURES IN METAL SHEETS BY DRAWING

The present invention relates to methods of and machines for forming metal sheets into compound curves by drawing or pulling the sheets from one end to the other longitudinally over successive forming elements, the working faces of which differ in contour transversely of the sheets and are disposed in a step relation to enable restraining or holdback forces to be exerted on the sheets in opposition to the pulling force so as to form the sheets into compound curvatures and sectors and the like, by such forming-by-drawing.

BACKGROUND

The process or method of the invention is a solution to the excessive cost of tooling and appalling waste of aluminum, steel, titanium, magnesium and other costly sheet metal generated by industry today. The process virtually eliminates expensive tooling (forming dies are not required), and it provides high-speed production with perfect repeatability in each process.

As later explained, machines of this character consist of two major units. The first is the forming unit through which flat sheets pass and emerge in a curved shape. The second is the power unit that grips one end of the sheet and pulls it through the working elements in the forming unit. The forming unit contains the elements with adjustable cams that provide a transverse curve for the elements. The power unit supports programmable traveling cams that transmit synchronized movement through sensitive electronic tracer controls to each element for positioning. Working together, the cams and elements produce the desired complex metal shape.

During the process, localized forces of a designed magnitude and direction are applied through the area and thickness of the metal sheet. The resulting continuous flow of infinitesimal forces results in a blended plastic formation of the metal virtually eliminating residual stress levels.

Techniques and appropriate machines of this character are described, for example, in Anderson U.S. Letters Pat. Nos. 2,395,651; 2,480,826; 2,851,080; 3,958,436; and other patents and prior art cited therein. Generally, such machines involve three stage functions—a sheet forming structure, a draw bench including a power actuated carriage for the mechanism, and a sheet pulling mechanism attached to and propelled by the carriage for gripping and drawing the sheet through the forming structure. That forming structure generally comprises three successive longitudinally spaced stages through which the sheet progressively moves.

In the first stage, a slot is defined by upper and lower relatively movable boundary surfaces having curvature-forming beads extending transversely across the sheet, with the upper and lower portions movable towards one another and from one another to engage the sheet and to be released therefrom with a restraining or constraining action provided as the sheet is bent about these beads, and which determines the general path of movement of the sheet. The next successive or second stage also has a slot that is formed by a draw-over forming element mounted usually on a vertical movable ram which, when closed to operating position, has its work-engaging face of different contours disposed in stepped (such as lower) relation to the entry slot of the second stage, actually to stretch and draw the sheet over the forming element, transversely across the sheet. The third stage also has a forming element, which may be of similar form to and contour of that of the second stage, also disposed in step relation so as to engage the side of the sheet that is opposite that engaged by the second stage forming element and serving to bring the contoured sheet along the direction of drawing. That drawing is effected by jaws or grippers that grip the head end of the sheet and, under control of the motor or some other power source, pull the sheet through the successive first, second and third stages to result in the compound curvature that is desired.

As more particularly explained in said U.S. Pat. No. 3,958,436, dynamic control of that forming with provision for responsiveness to the control mechanisms as sensed by contour monitoring sensors, enables control of the forming in accordance with such sensing during the drawing of the sheet through the stages. Such sensing of transverse physical dimension of lateral contour changes during the travel thus provides control signals for dynamically and electronically controlling the position of the forming elements at least relative to one another.

Generally, the first stage of transversely extending beads that bend and constrain the entering sheet material transversely across the sheet have involved double or multiple upper beads or ridges and corresponding parallel lower beads and valleys mating therewith which have been found necessary to provide the setting of the general path of movement of the sheet to the second drawing stage, particularly in the case of first stages that have substantially horizontal or flat bead structures. Where, for various compounding curves and materials, it is desired to introduce curvature, in a concave sense, transversely across the sheet in the first stage bead and slot, however, this structure does not provide the necessary flexibility for such purposes. It has been found, however, that a simpler single bead structure is then more workable. The double or other beaded boundaries of the first stage slot of the prior art, moreover, have been rearwardly provided with flat sections that move together with the contoured bead surface down onto the sheet in unison. As the bead starts to depress into the sheet material and bend the same for the desired path of travel to the second stage, the rearward flat portion is well above the sheet material, and the rearward portion thereof deflects upward and introduces instability into the operation, this being particularly so where the bead is formed into a curved structure transversely across the sheet.

This problem may be admirably solved by separating the rearward surface from the contoured or beaded part of the slot, independently moving it vertically downward to a predetermined clearance from the sheet. Under such circumstances, as the bead starts to depress into the sheet to bend it, the portion rearward thereof is not subject to the same deflection effects of the prior art construction.

While it has heretofore been proposed to curve the forming or constraining beads of the first stage, as for example on pages 50 to 52 of "Final Report on Effects of Andro forming on Material Properties" of the General Dynamics/Fort Worth Applied Manufacturing Research and Process Development Company for the U.S. Air Force, published November 1963, the provision of such radically modified bead contouring construction and the rearward surface independent adjustment to a predetermined gap clearance of the sheet have not heretofore apparently been discovered or known.

In such systems, the first stage bead or contoured constraining slot is positioned above the entry of the slot of the second stage and is generally transversely flat across the first stage. While this has been found to be useful for some thicknesses and strengths of sheet metal, this kind of operation has now been found to introduce wrinkles, ripples and other deleterious effects when relatively thin and sometimes composite metal surfaces and the like are employed, particularly metals and composites and alloys of quite different stress yielding points. This has also been found to be a disadvantageous method of operation for the above and other reasons where curvature transversely across the first stage is to be effected, as with concavely contoured first stage beads.

OBJECTS OF INVENTION

An object of the present invention, accordingly, is to provide a significant improvement in method of and machines for forming compound curvatures in metal sheets by longitudinal drawing that shall not be subject to the last-named disadvantages and others but that, to the contrary, shall be particularly useful, though not exclusively, with first stage contouring bead constructions that are particularly concavely curved for imparting compound curve effects in the sheet, such improvement to enable wrinkle-free and ripple-free drawing of curved sheets even if very thin.

A further object is to provide for the contouring of paraboloidal antenna reflectors and the like with rather critical relative positioning, dimensioning and design of the forming elements.

Under these circumstances, vastly improved operation has been found to occur, moreover, if the tail end of the sheet is also held clamped to a fixed carriage carrying the sheet as it is drawn through the three stages, with the clamp sliding toward the first stage as the sheet is longitudinally drawn successively through the first, second and third stages. In accordance with this further feature of the present invention, means is provided for automatically releasing the clamp and thus the tail end of the sheet just before it reaches the first stage. With this feature also incorporated in combination with the above-described novel positioning, dimensioning and curvature design of the stages, greatly improved results have been obtained.

While the previously cited U.S. Pat. No. 3,958,436 discloses the concept of sensing the variations in shape or other contour of the sheet with transducers and providing control signals that will allow adjustment of the space between the first and second stage, and between the second and third stage, it has now been found that through the use of servo feedback loops, a further element of variation during the forming may be achieved in varying the vertical position of the first stage relative to the second stage. This new concept has been found to add a new dimension to complex contouring and compensation for, for example, the tapering of the sheet from a large width at the head end to a narrow width at the tail end. These adjustments of relative positioning of the stages during the drawing and in response to the sensing of dimensional and desired contouring variations may thus automatically be effected. Under the control of the servo feedback loops, very accurate preforming is achievable, enabling the invention to be highly advantageous for complex compound shaping of antennas, reflectors, aircraft skins and other applications of similarly tolerance requirements.

A further object of the invention, accordingly, is to provide such an improved sheet material drawing and forming machine with features of novel tail-end and extended servo feedback controls.

Other and further objects will be explained hereinafter and will be more fully delineated in the appended claims.

SUMMARY

In summary, from the viewpoint of its important application to the forming of accurate compound paraboloidal and similar sheet curvatures, the invention involves a method of forming sheet materials of varying width by providing three longitudinally spaced stages of forming beads each extending transversely of the sheet and through which the sheet is to be fed, and positioning the beads of the first stage a predetermined height $V_{12}$ vertically above the second stage to bend the sheet downwardly therebetween; longitudinally positioning the beads of the second stage from the first stage a distance $H_{12}$ large compared to $V_{12}$ with continuing of the downward bending throughout such distance; longitudinally positioning the beads of the third stage from those of the second stage a distance $H_{23}$ more comparable to $V_{12}$ and vertically somewhat above the second stage to bend the sheet upwardly at the second stage and then somewhat downwardly at the third stage; adjusting the transverse curvature of the beads of the first, second and third stages to be substantially the same; and varying one or more of the distances $V_{12}$, $H_{12}$ and $H_{23}$ and the relative vertical positions of the second and third stages while the sheet is passing through the successive stages with successively decreasing sheet width to compensate for such decreasing sheet width. From another view, the improvements of the invention also embody an improvement in the method of drawing sheet metal to form compound curvature sheets while obviating wrinkles and ripples therein, and in which the drawing is effected by longitudinally drawing the sheet through a first stage slot bounded by sheet-restraining transversely extending bead means, longitudinally passing the sheet to a second stage providing a transverse slot having work-engaging forming elements in longitudinally stepped relation, and longitudinally passing the sheet over a third stage surface engaging the side of the sheet opposite that engaged by the second stage forming elements, the improved method comprising the steps of (a) adjusting the first stage slot so that the portion of the sheet bent around the first stage bead means is above the level of the portion of the sheet received in the second stage slot and drawn over its said forming elements, with the sheet portion therebetween inclining downwardly between the first and second stages;

(b) clamping the tail end of the sheet, prior to said drawing; and (c) sliding the clamp toward the first stage as the sheet is longitudinally drawn successively through the first, second and third stages, and releasing the clamping just before the tail end reaches the first stage.

Preferred and best mode machine apparatus designs and process steps are hereinafter more fully described.

DRAWINGS

The invention will now be described with reference to the accompanying drawings, FIG. 1 of which is a schematic isometric view of a machine for practicing the forming-by-drawing technique of the invention;

FIGS. 1A through 4E are schematic fragmentary side elevations or sections showing successive forming steps and sheet grabbing and drawing steps, and illustrating, for certain applications, the first stage somewhat below the second and third stages;

Figure 2:
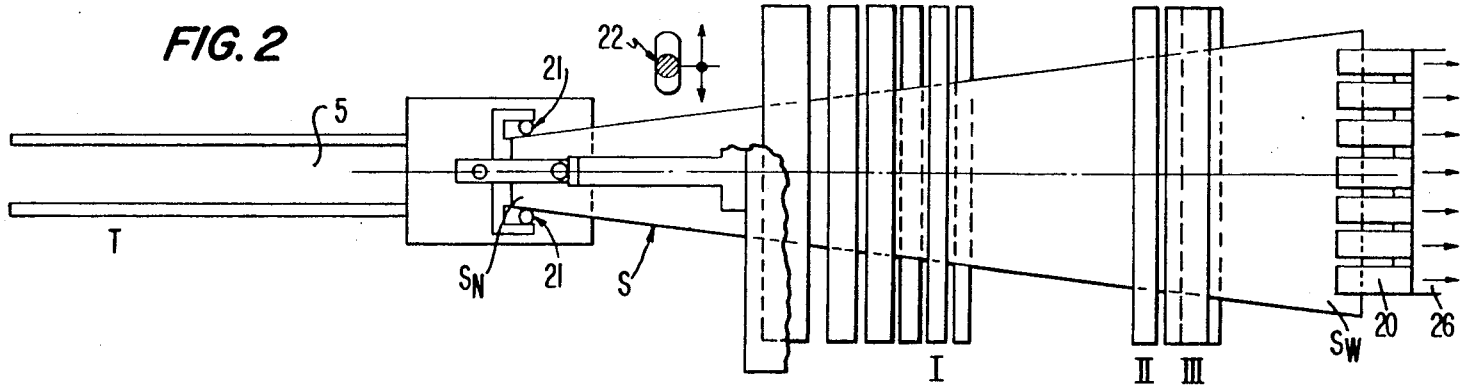
FIGS. 2 and 3 are respectively top and side elevations of the same, with the latter schematically representing the servo control motions therein.
Figure 3:
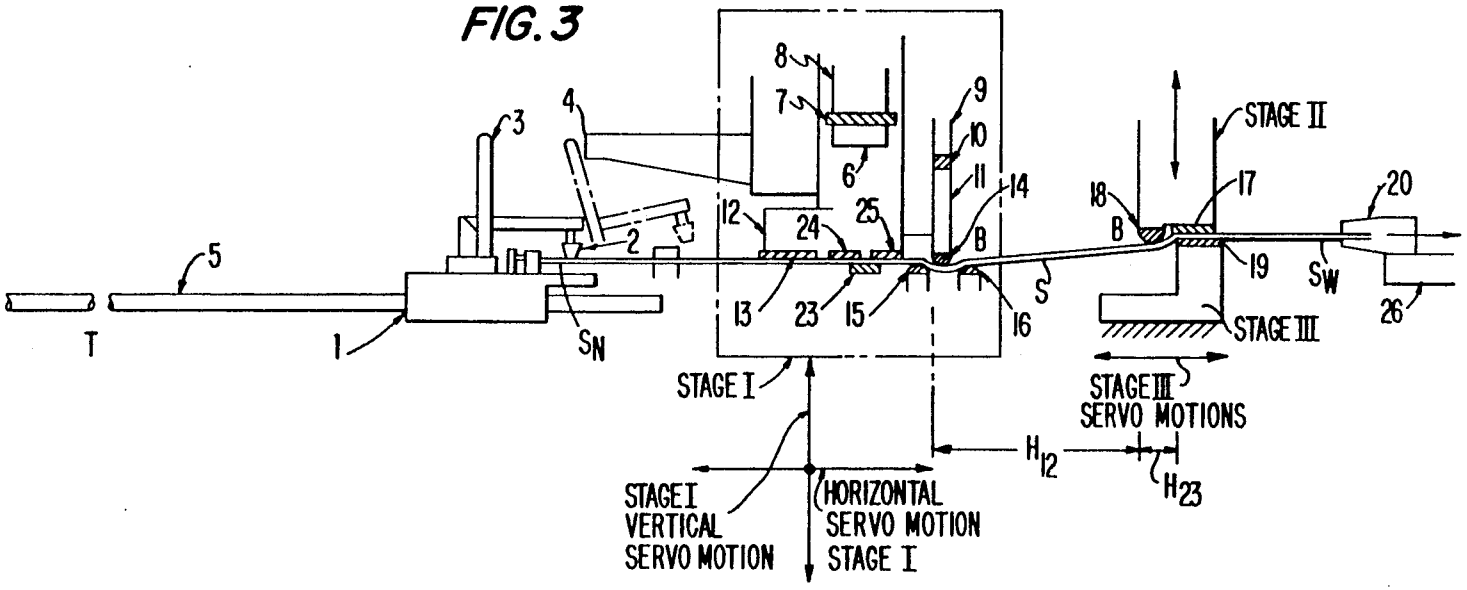
Figure 5:
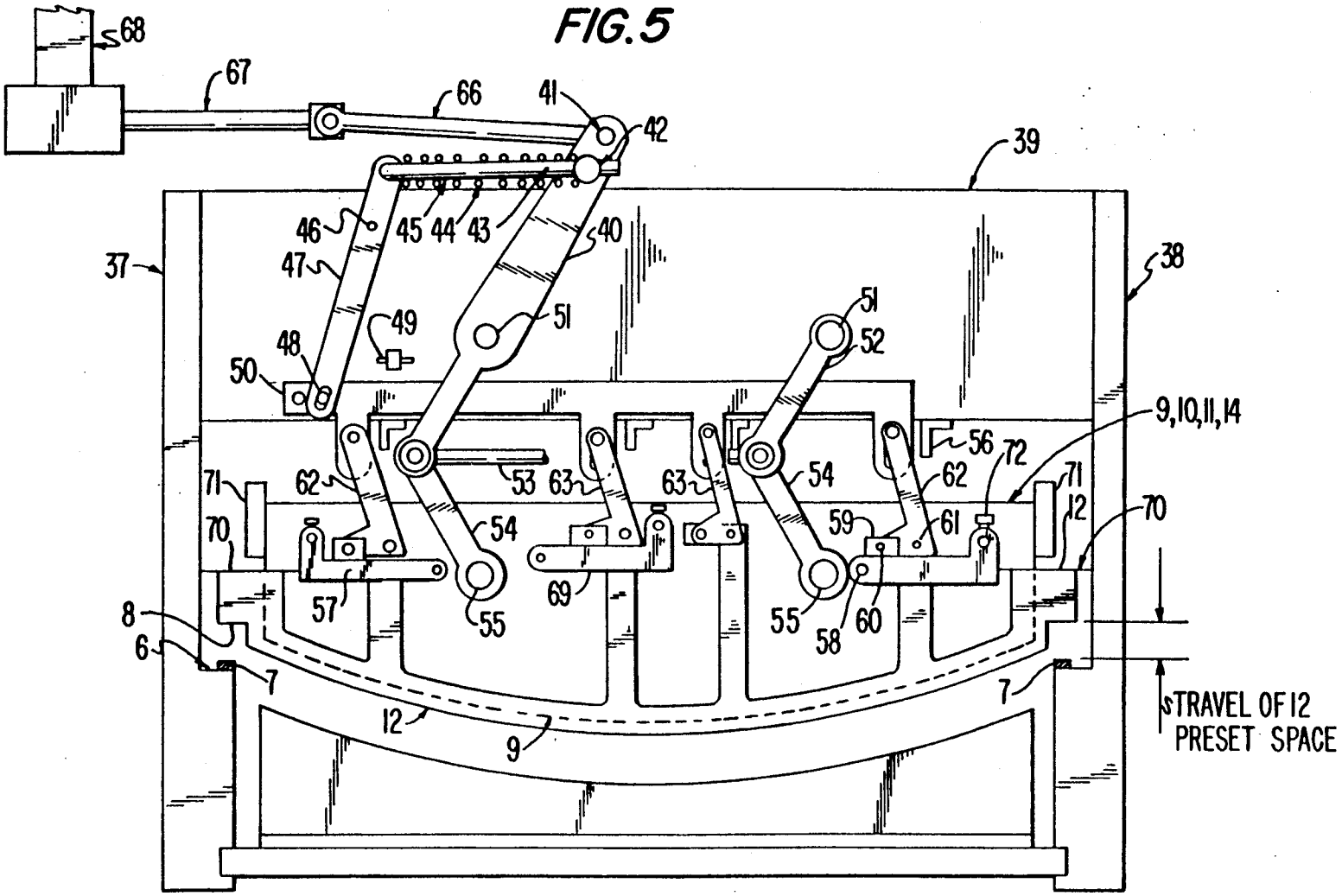
Figure 8:
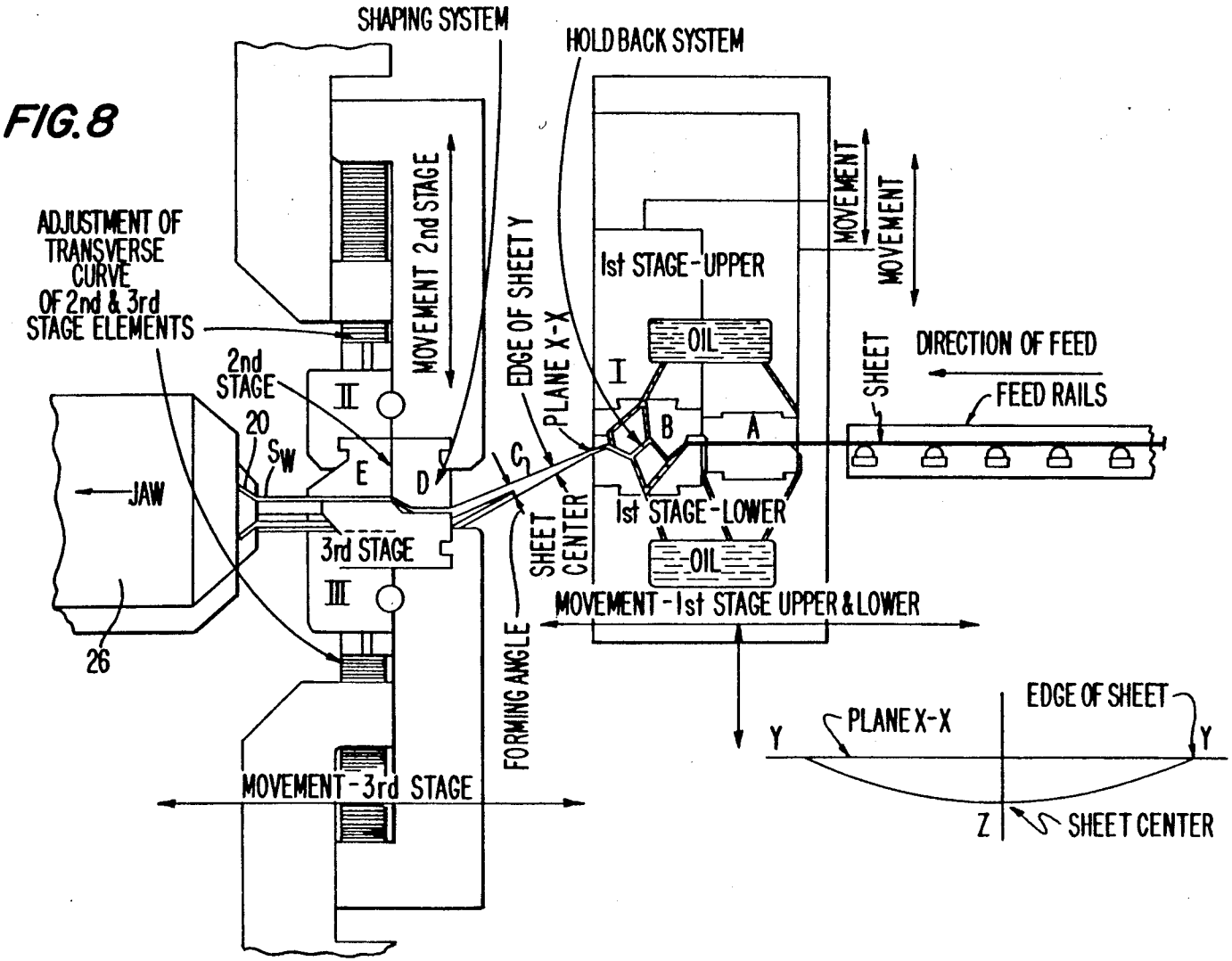
Figure 9:
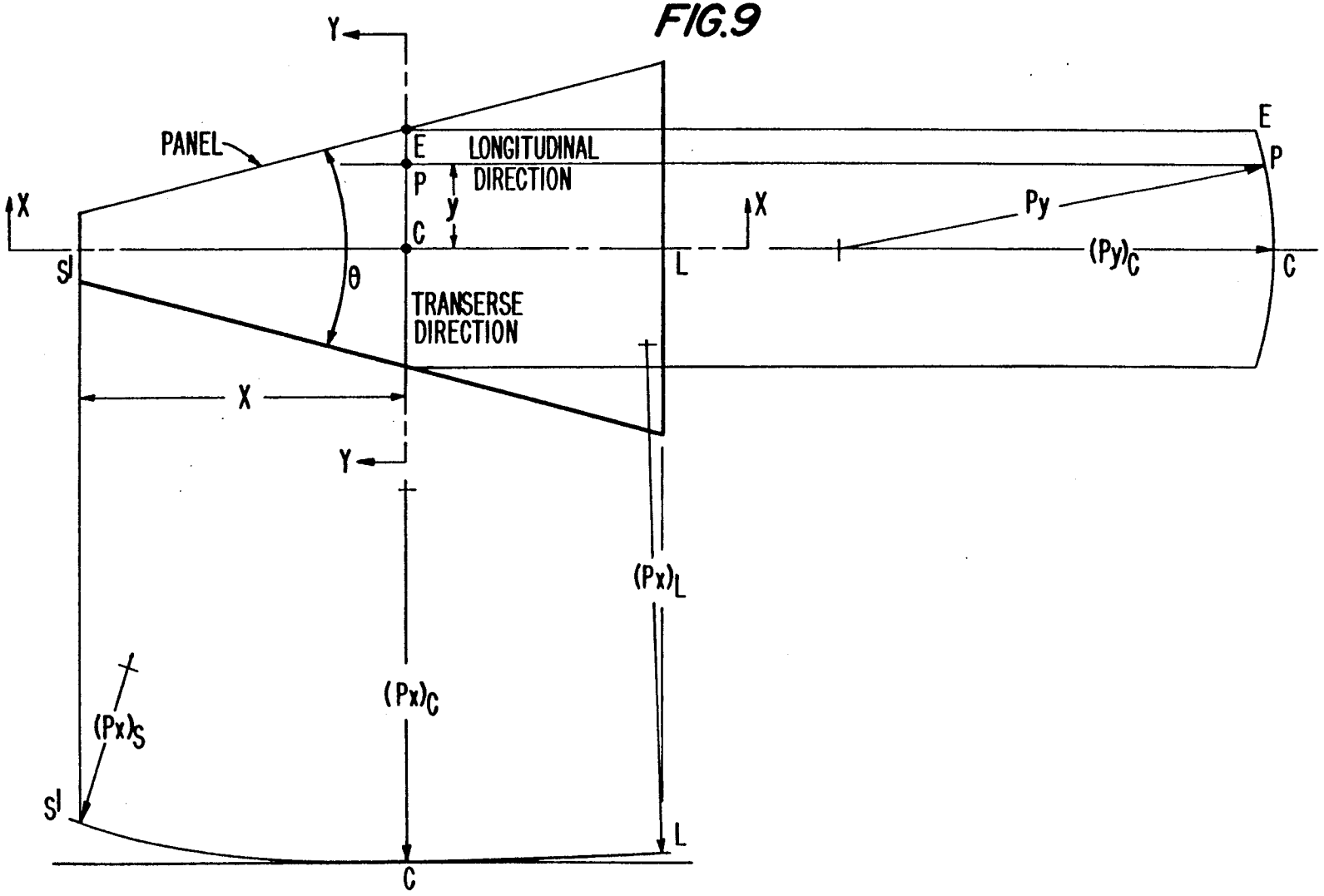
Figure 10:
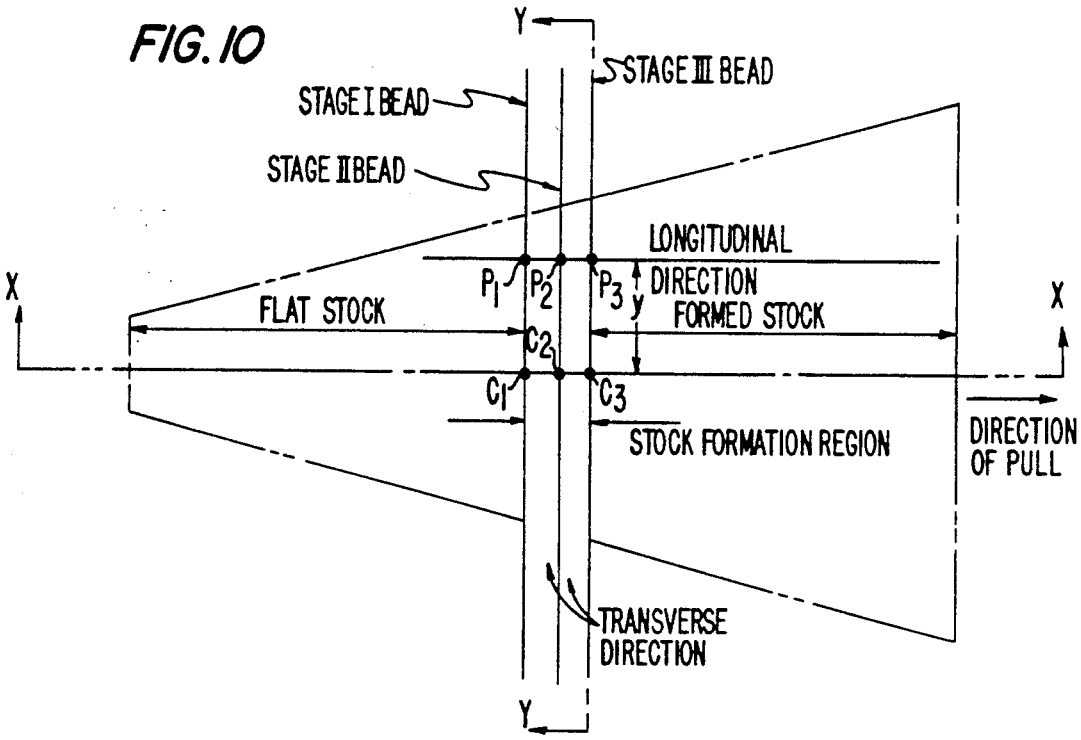
Figure 12:
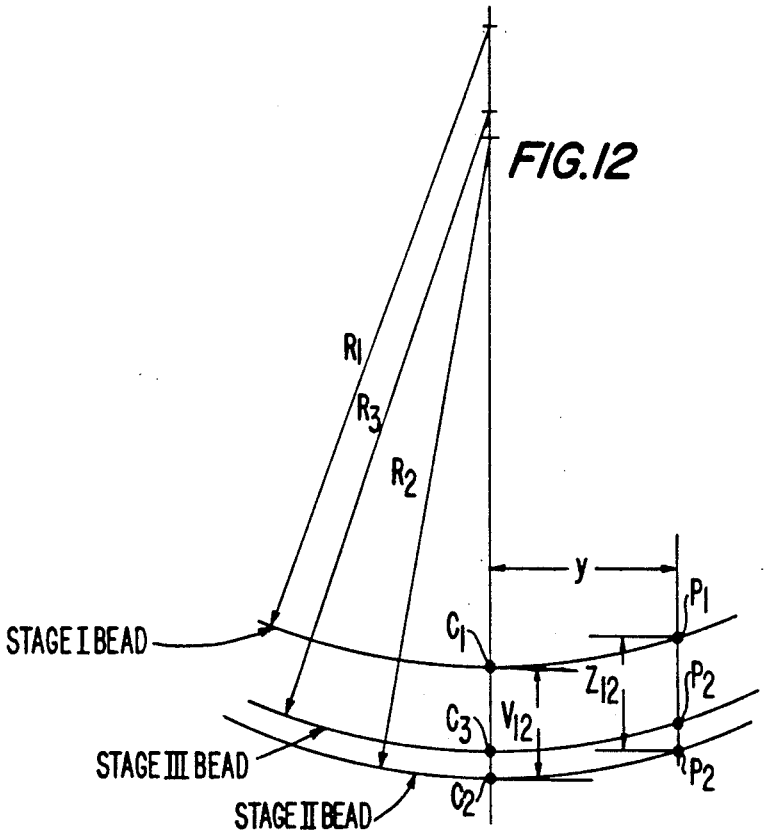
Figure 11:
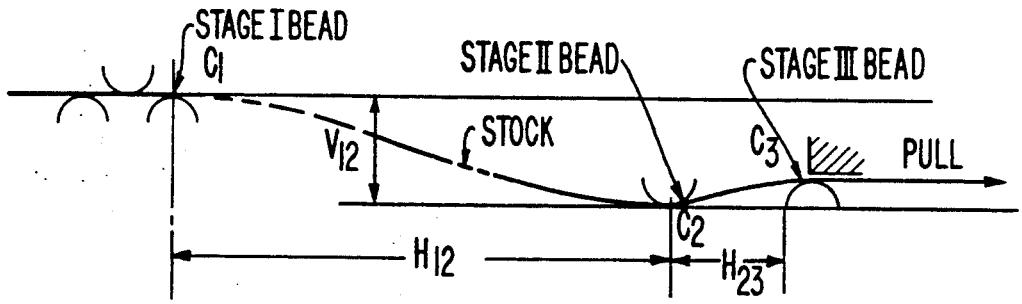
Figure 13:
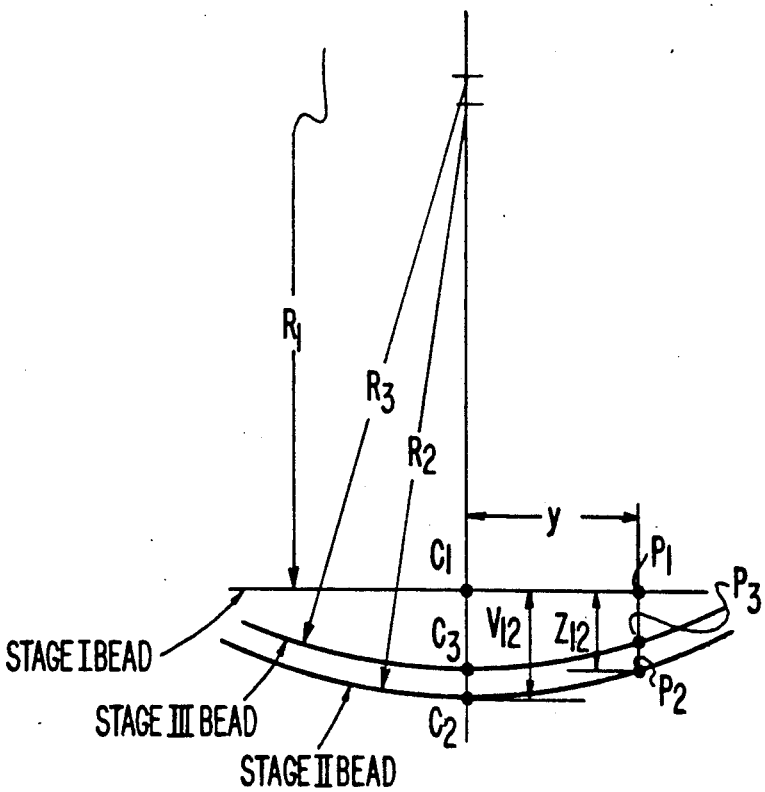

FIGS. 5 though 7 are end-on views in more detail and upon an enlarged scale of successive steps in the operation of the first forming stage with its lost motion and predetermined sheet gap or clearance adjustment operation;

FIG. 8 is a somewhat more detailed view similar to FIG. 3 (though oriented in the opposite right-to-left direction than the other figures) of the process and machine of the invention adjusted for the forming of paraboloidal and similar compound curves, with the first stage critically longitudinally and vertically positioned relative to (above) the second and third stages as before-mentioned and hereinafter more fully described;

FIG. 9 is a diagram of the basic geometric characteristics of a parabolic reflector panel used in accordance with the invention;

FIG. 10 is a top view similar to FIG. 2 of the forming layout;

FIG. 11 is a side view or longitudinal section, similar to FIG. 3, but showing the first stage above the second and third stages in actual relationship for paraboloidal contouring;

FIG. 12 is a fragmentary transverse section (of FIG. 10) illustrating the required stage bead curvatures and vertical positionings; and FIG. 13 is a similar view of an unacceptable and indeed prior art type of adjustment.

INVENTION

Figure 1:
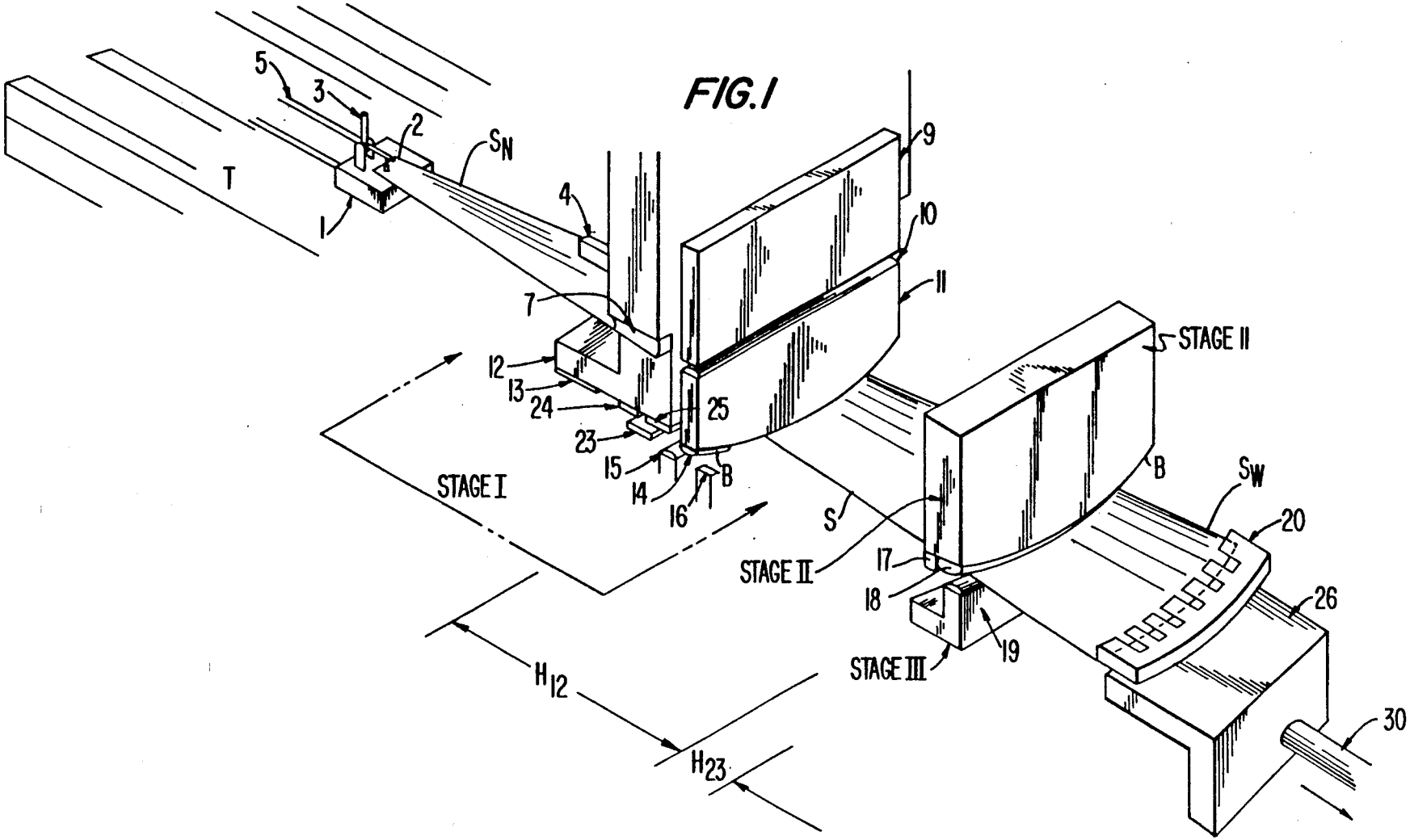

In order to make clear the novelty of the apparatus and forming methodology of the present invention without the confusion of the details of well-known mechanical structures, as shown and described in said prior patents, reference will first be made to the schematic drawings of FIGS. 1 through 3 illustrating the longitudinal passing of the metal or other sheet material S to be incrementally formed into the desired compound curve, shown of tapered or trapezoidal form, widening from its narrow or tail end $S_N$ longitudinally to its wide or forward or head end $S_W$, as for forming into a sector of a radio reflector of paraboloidal or other curved shape or a curved sector of a more general structure as well.

Figures 4A, 4B, 4C:
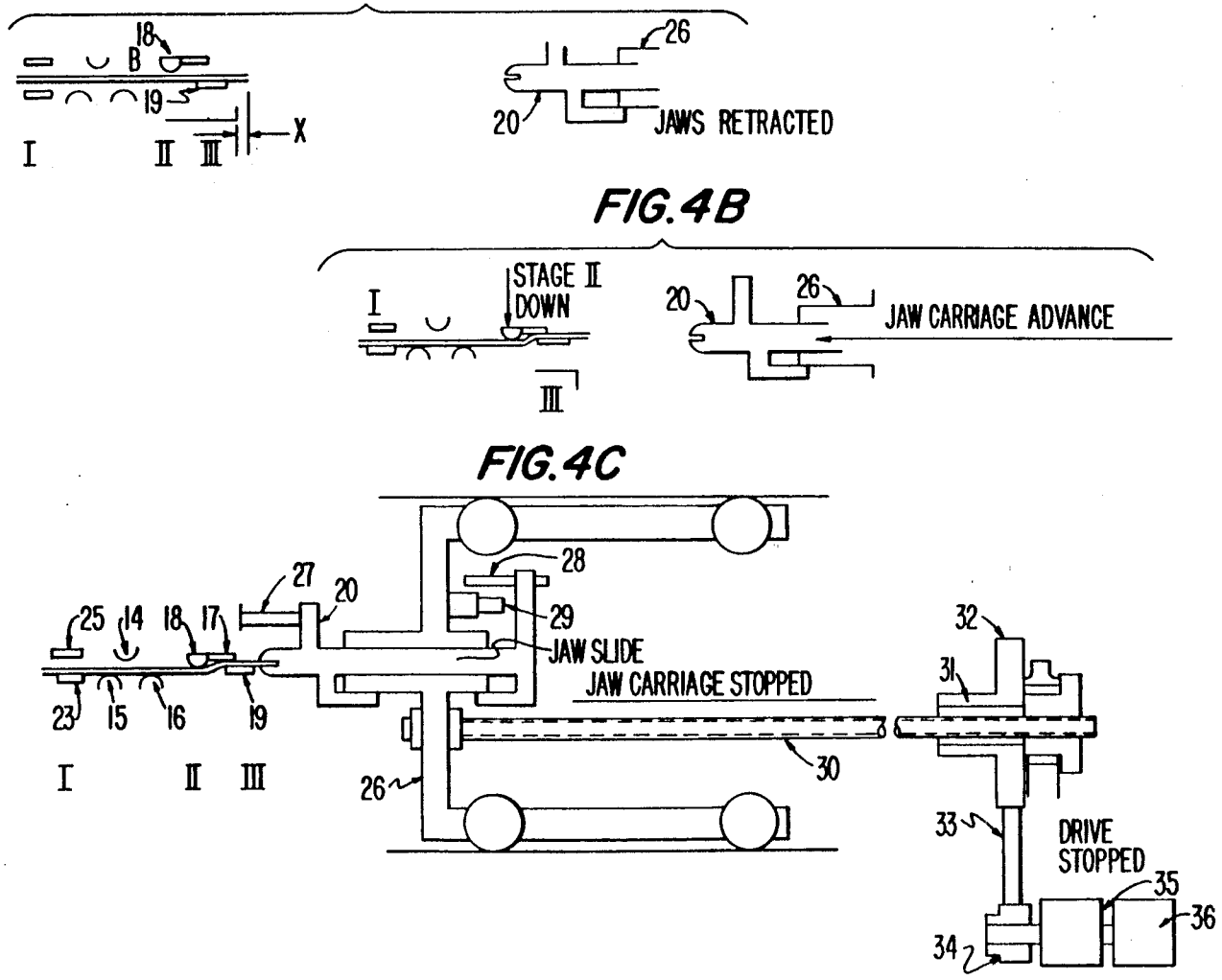
Figure 4D:
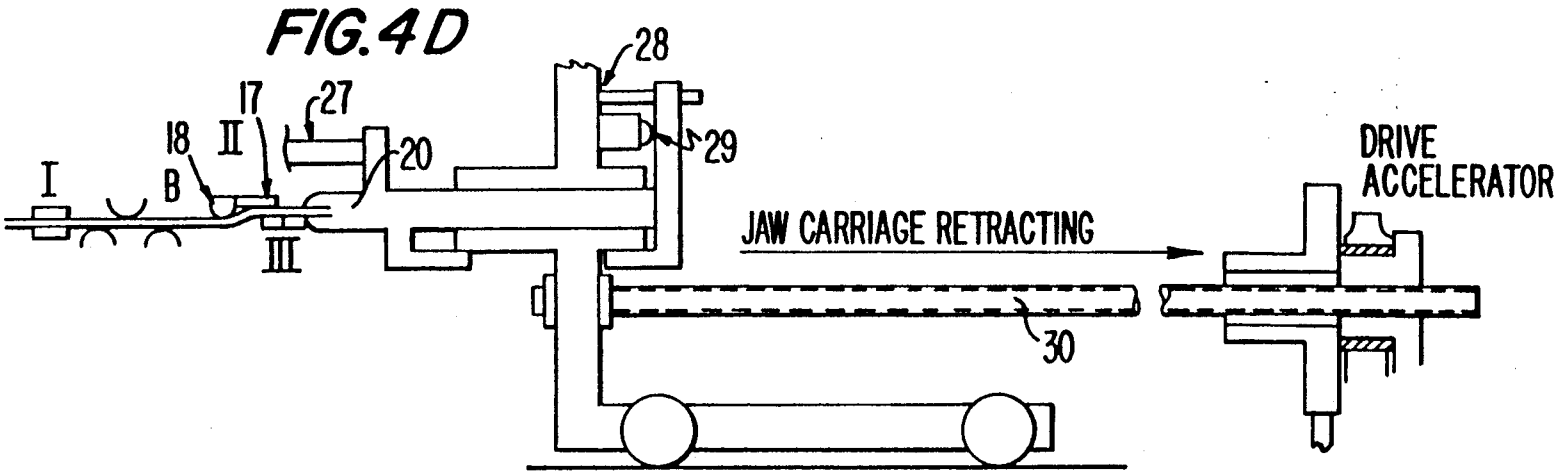

The parts identified in FIGS. 1-3 include a slide 1, FIGS. 1-3, carrying a clamp 2 operated by a handle 3 and engaging the narrow or tail end $S_N$ of the sheet S, locating and holding that tail end of the sheet-to-be-formed. A stop shoulder is provided at 6, FIG. 3. Adjustable tail end and sheet side locators are shown at 21 and 22 in FIG. 2. A slide rod 5 is attached to the feed table or frame T, such that when the sheet S is pulled to the right, as later explained, the clamp handle 3 engages a bumper 4 to pivot the clamp handle 3 and clamp 2 upward (shown at the dotted position in FIG. 3) to open the clamp and release the tail end $S_N$ of the sheet S. The forward or head end $S_W$ of the sheet is shown received in a lost-motion jaw slide 20 carried by a jaw carriage 26, motor-driven along a jaw carriage screw 30. As more particularly shown in FIGS. 4A-D, the motor 36, through transmission 35, pulley-driver 34, driven pulley 32 and timing belt 33, actuates jaw carriage screw 30 with an associated nut 31. A later described shock absorber 29, FIGS. 4C and 4D, is provided with a jaw slide positive draw stop 28 and reset bumper 27.

Three forming stages I, II and III, are shown, each to carry curvature-forming beads B extending transversely across the sheet, stage I being disposed a longitudinal distance $H_{12}$ from stage II, which, in turn, is disposed a much closer distance $H_{23}$ from adjacent stage III. Stage I is provided with an upper bead B element holder 11, FIGS. 1 and 3, lost motion slide 12, the slide lug of which is shown at 8 in FIGS. 3 and 5-7, with the with the stage I upper slide at 9 (also more particularly shown in FIGS. 5-7). The upper elements, FIG. 1, are of transverse curve shape and include elements 13, 24 and 25 (rectangular cross-section) and element 14 (radial cross section), with lower elements also having transverse curves 15, 16 (radial cross-section) and 23 (rectangular cross-section) also being provided. Spacers 7 and 10 are provided, FIG. 3, with the spacer 7 more clearly shown in FIGS. 5-7, respectively to set the gap for the sheet S between the upper and lower stage I elements and for the set holdback. Stage II is similarly provided with upper elements 17 and 18 with transverse curve and respective rectangular and radial cross-section; and stage III, with lower elements 19, FIG. 1, with transverse curve and rectangular cross-section. The transverse curves of elements 14, 25 and 15 and 16 may be adjustable or fixed.

As later explained, for different applications, the transverse curving of the stages may be reversed to those illustrated or may be made similar. Thus, in the more detailed mechanical drawings of FIGS. 5, 6 and 7, stage I with its upper slide 9 and lost motion slide 12, curves upwards, the upper slides 9 and 12 being shown in raised or open position in FIG. 5. Similarly for the upper bead element holder 11 and the upper radial cross-section upper element 14, the same elements shown in FIGS. 1 and 3. Other elements illustrated in the more detailed drawing of FIG. 5 include the side plates 37 and 38 on the machine frame T and top plate 39; and an upper long link 40 with pins 41 and 42, the former of which connects with a long link connecting rod 66, and the latter, the rods 43, 45 with spring load 44 The upper link pivot 46 on a linear slide drive arm 47 is driven by driver 48 connected with the linear slide 50, shown horizontally disposed with a stop screw positioned at 49. An upper short link 52 pivoted at 51 operates through a connecting rod 53 with a lower link 54 pivoted at 55, a backstop being provided at 56. An adjusting plate is shown at 57 pivoting at 58, with an adjusting screw at 72.

The before-mentioned lost motion operation is effected with a lost motion slide rod 61 cooperating with a short pivot sliding block 59 with pivot pin 60 and a long pivot slide block 69. Respective short and long backstop arms 62 and 63 are provided, the system being actuated by a drive motor 68 actuating a linear actuator 67 linked at 66 to the before-described upper pin 41 of the upper long link 40. The lost motion slide linear bearing is shown at 70, and the linear bearing of the stage I upper slide at 71.

Figure 6:
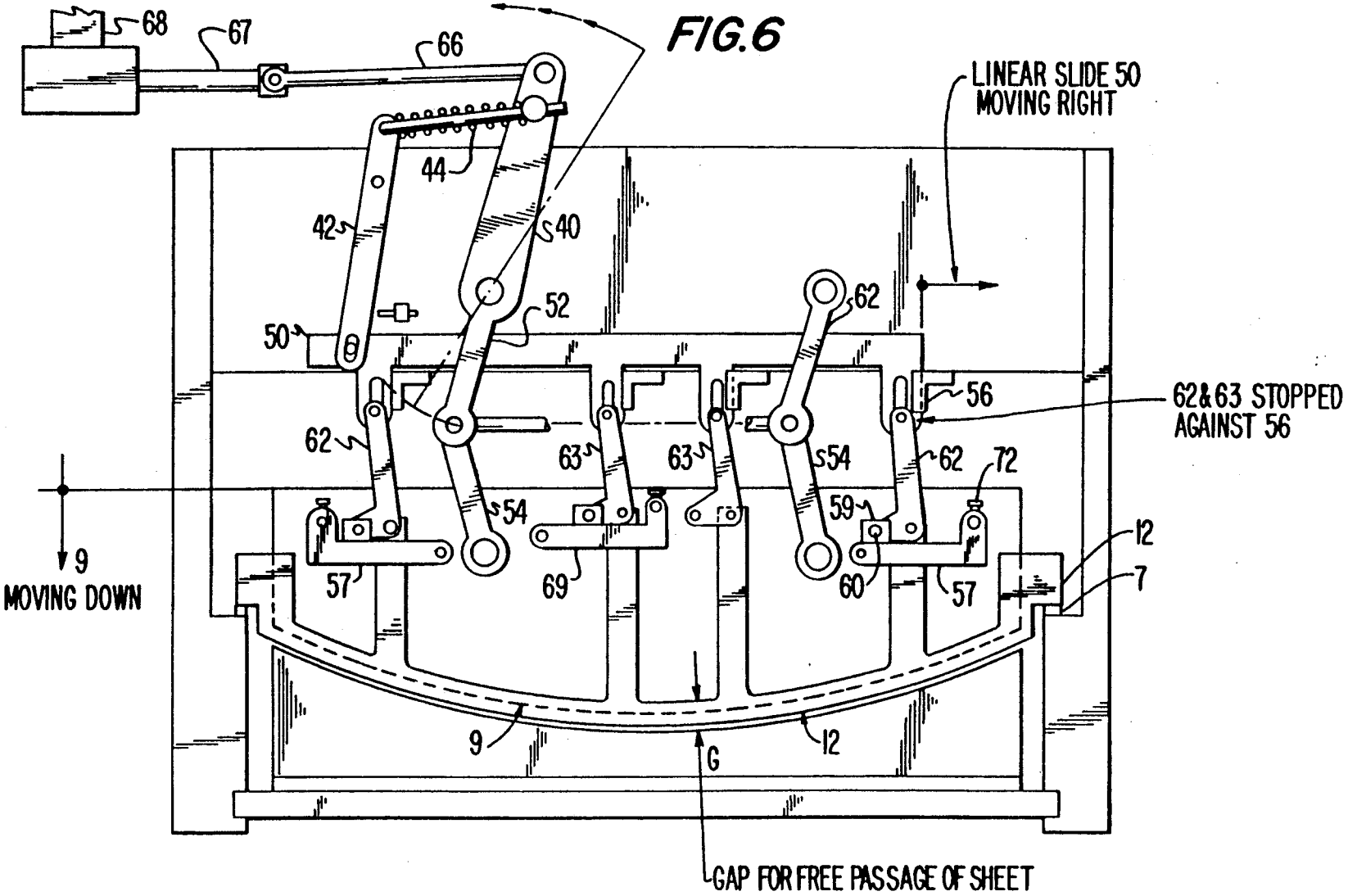
Figure 7:
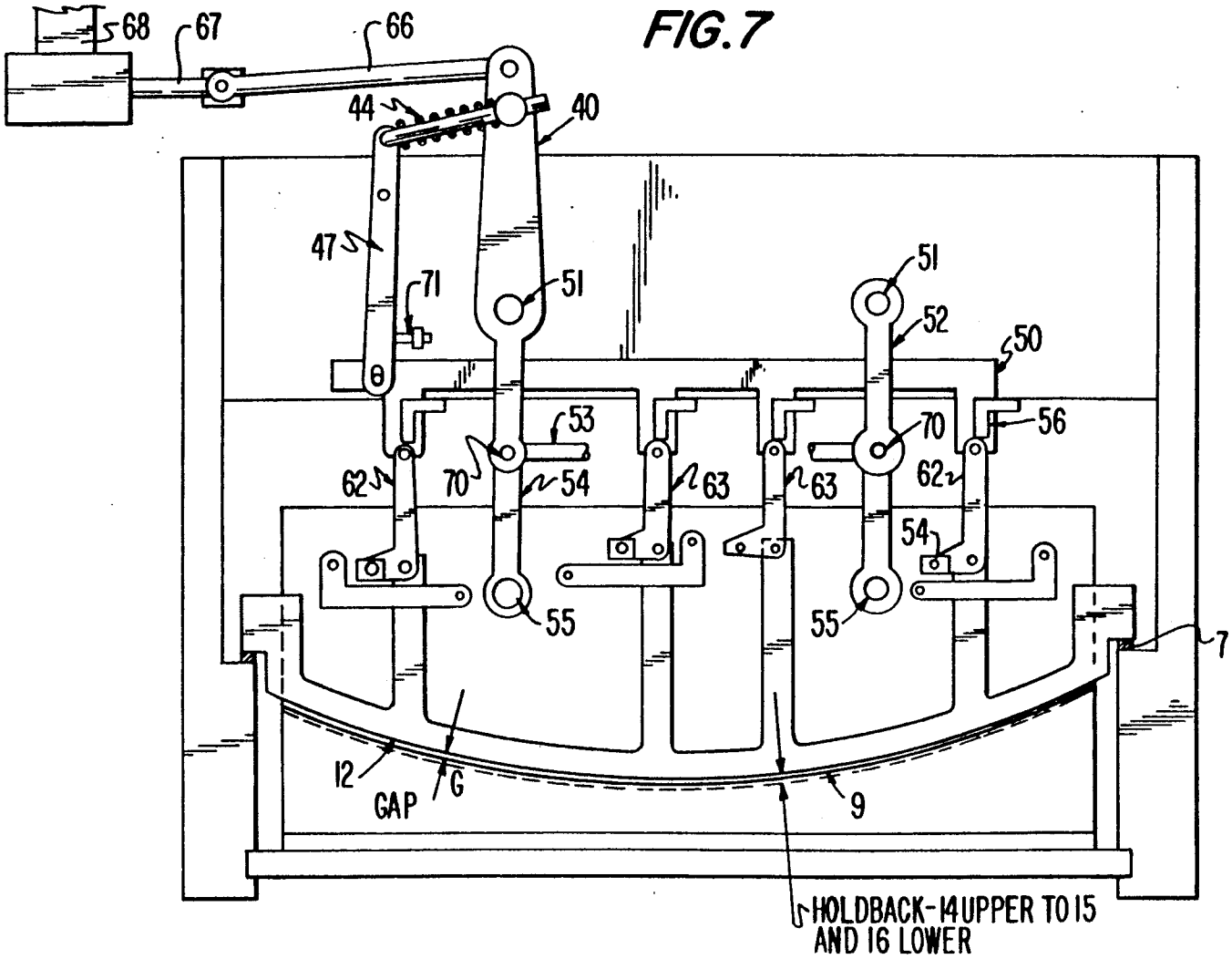

While FIG. 5, as before stated, shows the upper slides 9 and 12 of stage I in raised or open position, to illustrate the stage I upper lost motion operation, FIG. 6 shows the positioning when the slide 12 has stopped against spacers 7 with the slide 9 moving down and the backstop or arms 62 and 63 spring-loaded and stopped against the backstop 56. The upper element lost motion slide 12 is stopped against spacer 7, leaving a gap G for free passage of the sheet S. FIG. 7 shows the next position of the lost motion slide to the desired preset gap G, with the slide 9 in the downward position from FIG. 6, backstopped by backstop arms 62 and 63 at 56 which have been pushed into place by the before-described spring-loaded linear slide 50. In this position, the upper stage I element 14 is held back from the lower elements 15 and 16.

It is now in order to trace the incremental forming of the sheet material into any of a variety of compound curves —for example, the paraboloidal curve of antenna reflectors or curved aircraft skins or the like. A particular sequence of operation will be described looking at the machine with the sheet material S being pulled through from left to right in FIGS. 1–7 and with manual locating steps, though automatic feed may also be employed.

Figure 4E:
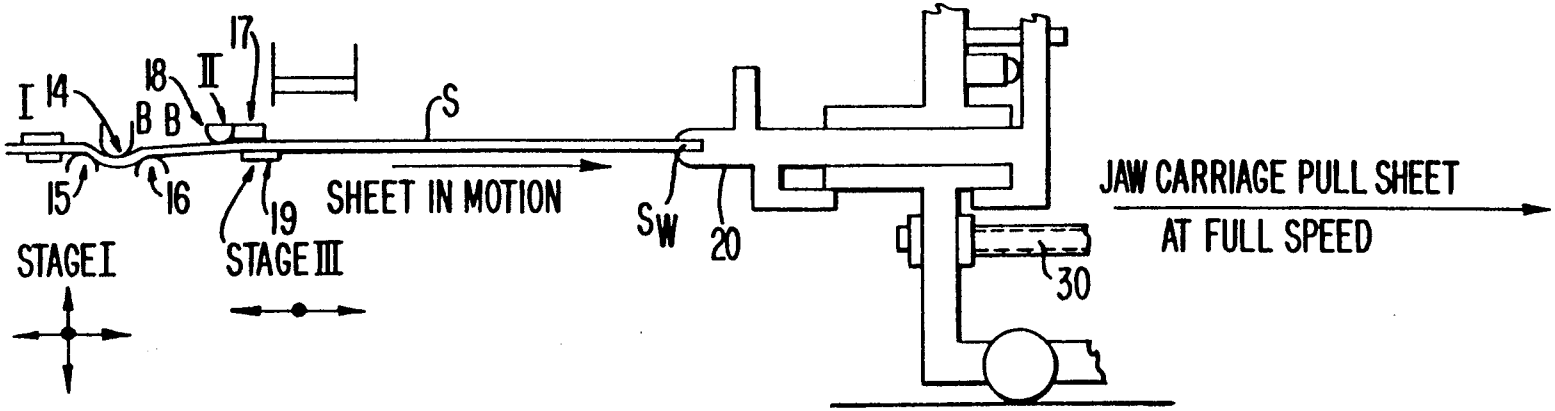

For purposes of generalization and illustration, the stage I of FIGS. 3 and 4 is shown below the stages II and III; whereas, for paraboloidal curvatures, the reverse is true as more particularly shown and described in connection with the embodiment of FIGS. 8 and 10–12.

1. Manually place the sheet S on the loading table at the left end of the machine.

2. Manually push material left to right, through the open stage I under open stage II and over stage III to a predetermined distance X shown in FIG. 4A. The material in this illustrative case is a dish antenna tapered segment and is manually located centrally about the machine longitudinal axis with the wide end $S_W$ first.

3. Automatically lower the stage II upper element to bend the metal into a transverse curve between stages II and III. The material now is held to a transverse curve to match the curve which has been preset in the pull jaws 20.

4. With the jaws 20 open, advance the jaw carriage right to left as in FIG. 4B.

5. Near the end of the jaw carriage advance, bumper 27, FIG. 4C, resets the jaw slide 20 lost motion, and resets shock absorber 29. A conventional cam on the jaw carriage trips a conventional limit switch (not shown) to stop the motor 36, which stops the jaw advance. The jaws at this point are still open but in position, ready to close on the wide end $S_W$ of the sheet to be pulled 6. Close jaws 20 to grip the sheet.

7. Start oil flow, FIG. 8, to lubricate both sides of the sheet, such lubrication being preferably electrically interlocked with the jaw carriage so that the sheet cannot be pulled without lubrication.

8. Close stage I which sets the holdback 14, 15, 16 to a predetermined dimension and the elements 13, 23, 24, 25 for predetermined clearance.

9. Begin the jaw carriage motion, left to right, FIG. 4D. Friction between the sheets and stages I, II and III overcomes the friction in the lost motion of the jaw slide 20. This causes the jaw slide to slip relative to the jaw carriage. At this point, shock absorber 29 begins working and motor 36 has time to accelerate. When the positive step 28 is bumped by the jaw carriage, friction between the sheet and the stages I, II and III is overcome, and the sheet begins to be pulled by the jaws through the forming stages for compound forming in finite increments.

10. During this part of the cycle, depending on the compound curve required on the sheet being formed, one can operate stage I vertically or horizontally, and stage III horizontally by use of three separate and independent servo controlled motions indicated schematically by arrows in FIG. 3. This allows an infinite number of position combinations between stages I, II and III, as desired. Another choice provided is that all three servo motions may be switched off, reducing the number of servo position variables coming into play during the machine cycle. The governing factors reside in how best to produce finished parts within required tolerances.

11. When the jaw carriage has pulled the sheet through, the before-mentioned machine cam on the jaw carriage trips the limit switch (not shown) to stop the motor 36 in well-known fashion, which in turn stops the jaw pull motion.

12. Push on unload cart under the sheet.

13. Open the jaws.

14. Pull the sheet from the open jaws onto the unload cart.

The various phases and specific rather critical dimensional relationships required for accurate paraboloidal compound curvature of tapered flat stock in accordance with the invention for antenna reflector applications and the like will now be addressed with reference to the diagrams of FIGS. 9, 10, 11, 12 and 13.

FIG. 9 shows such a typical parabolic reflector panel. Section Y—Y is at an arbitrary location x from the small end S', defining general point C along the panel centerline. Point P is a general point on the panel, located at an arbitrary distance y from point C, in a transverse direction to the panel centerline. For parabolic reflector panels, the angle $\theta$ in FIG. 9 is relatively small, such as $0=15°$.

The panel is symmetric about its centerline, as shown. Its surface has compound curvature, defined at general point P by radii $\rho x$ in the longitudinal plane (parallel to the centerline plane) and $\rho y$ in the transverse plane (normal to the centerline plane). For a parabolic panel, radius $\rho x$ decreases in magnitude from the large end L to the small end with an accompanying decrease in $\rho y$. The decrease for x is generally illustrated in section X—X at the bottom of FIG. 9. However, at an arbitrary location X, radii $\rho$and $\rho y$ must be virtually constant along the transverse direction (C–P–E), for a parabolic reflector panel.

Reviewing the forming process underlying the invention for producing compound curvature on the surface of thin stock which is initially flat, this is accomplished by pulling the stock through the three stages of beads, as diagrammed in FIG. 11. The stock is formed plastically in reversed bending as it passes through stages I, II and III. The beads, as before described, are generally curved, as shown in the transverse plane, with constant radii of curvature designated by $R_1$, $R_2$ and $R_3$ for stages I, II and III, respectively, as indicated in FIG. 12. The particular compound curvature formed in the stock at an arbitrary point P depends on the before-mentioned machine dimensions $H_{12}$, $H_{23}$ (longitudinal spacing between stages I and II and between stages II and III, respectively) and also $Z_{12}$, and the bead radii $R_1$, $R_2$ and $R_3$, shown in FIGS. 11 and 12. The particular compound curvature formed at an arbitrary point P is quite sensitive to these machine dimensions. Also, regarding notation, it should be mentioned that the centerline point C dimension $V_{12}$ (the height difference between the center beads of stages I and II, with the former located vertically above the latter) corresponds to the more general point P dimension $Z_{12}$, with $V_{12}$ being merely the dimension $Z_{12}$ for the special location at the machine centerline.

For production of stock with curvature which varies over its surface, dimensions $H_{12}$, $H_{23}$ and $V_{12}$ (which may be comparable to distance $H_{23}$) are continuously varied as the stock is pulled through the machine, though the distance $H_{12}$ is substantially greater than $H_{23}$ and $V_{12}$. However, a discovered relationship must be adhered to for the design of the machine in order to satisfy the required characteristics of parabolic reflector panels as described above. This will be explained next, bearing in mind the before-stated two important items related to successful production of parabolic reflector panels by the process of the invention:

1. Parabolic reflector panels have virtually constant radii of curvature [$\rho x$, $\rho y$] along a transverse direction, for any arbitrary location x, FIG. 9; and 2. To satisfy the parabolic reflector panel characteristic of item 1 above, the machine must be designed so that the general point P dimension $Z_{12}$ is virtually constant and equal to the center point C dimension $V_{12}$ That is, $Z_{12} \approx V_{12}$ must be satisfied over the entire transverse plane, as illustrated in FIG. 12.

Translated to the design of the machine of the invention, item 2 above is met only if bead curvatures are virtually or substantially the same for all three sets of beads of stages I, II and III. Mathematically, bead curvature is defined as the reciprocal of bead radius of curvature. Therefore, the design requirement is met mathematically by having $1/R_1$, $1/R_2$ and $1/R_3$ virtually the same, with only small differences allowed between these curvatures. Hence, for producing parabolic reflector panels or the like, design of the machine should be such that bead radii are virtually equal, having $R_1 \approx R_2 \approx R_3$ (say 60"–70", more or less). This design requirement is correctly satisfied in FIG. 12. An example of unacceptable design is shown in FIG. 13 with $R_1$ much greater than $R_2$ and $R_3$, wherein $Z_{12}$ would be appreciably different from $V_{12}$.

One or more of the distances $V_{12}$, $H_{12}$ and $H_{23}$ and the relative vertical positions of the stages II and III may be adjustably varied while the sheet S is passing through the successive stages with successively decreasing sheet width to compensate for such decreasing sheet width, as desired. Thus, for this application, the invention involves the method of forming sheet materials of varying width by providing the three longitudinally spaced stages I, II and III of forming beads B each extending transversely of the sheet and through which the sheet is to be fed, and positioning the beads of the first stage I a predetermined height $V_{12}$ vertically above the second stage II to bend the sheet downwardly therebetween, FIGS. 8 and 11. The beads of the second stage II are longitudinally positioned from the first stage a distance $H_{12}$ large compared to $V_{12}$, with continuing of the downward bending throughout such distances. The beads of the third stage III are longitudinally positioned from those of the second stage II a distance $H_{23}$ comparable to $V_{12}$ and vertically somewhat above the second stage II to bend the sheet upwardly at the second stage and then somewhat downwardly at the third stage III, FIGS. 8 and 11. By adjusting the transverse curvature of the beads of each of the first, second and third stages to be substantially the same and varying one or more of the distances $V_{12}$, $H_{12}$ and $H_{23}$ and the relative vertical positions of the second and third stages while the sheet is passing through the successive stages with successively decreasing sheet width to compensate for the decreasing sheet width. Compensation for such decreasing sheet width and corresponding decreasing radius of curvature may also be effected sufficiently to provide substantially constant curvature across any transverse sections. For paraboloids and similar curves, the sheets are preferably of somewhat trapezoidal or triangular outline as previously described.

While the illustrative example above is specific to paraboloids, the machine of the invention also has great potential for producing panels which are not parabolic reflector panels. Panels of other shapes can be formed, having varying curvature over the surface. To do this, dimensions $H_{12}$, $H_{23}$ and $V_{12}$ would be varied appropriately during machine operation. The bead design would also generally be such that $R_1$, $R_2$ and $R_3$ are somewhat different from one another and vary in magnitude along the transverse direction.

Further modifications will occur to those skilled in this art, such falling within the spirit and scope of the invention as defined in the appended claims.

What is claimed is:

1. In a method of drawing sheet metal to form compound curvature sheets in which the drawing is effected by longitudinally drawing the sheet through a first stage having a slot bounded by sheet-restraining transversely extending bead means, longitudinally passing the sheet to a second stage providing a transverse slot and having work-engaging forming elements in longitudinally stepped relation which engage a side of the sheet, and longitudinally passing the sheet over a third stage surface engaging a side of the sheet opposite that engaged by the second stage forming elements, an improvement which obviates wrinkling and rippling of the sheet, comprising the steps of (a) adjusting the first stage slot so that the portion of the sheet bent around the first stage bead means is above the level of the portion of the sheet received in the second stage slot and drawn over its said forming elements, with the sheet portion there-between inclining downwardly between the first and second stages;

(b) clamping a tail end of the sheet with a clamp, prior to said drawing; and (c) sliding the clamp toward the first stage as the sheet is longitudinally drawn successively through the first, second and third stages; and (d) researching the clamping just before the tail end reaches the first stage;

and in which a head end of the sheet is transversely gripped to enable the said drawing, with the gripping being adjusted to slip slightly as a motor controlling the drawing runs up to speed and with shock absorption effected during the slipping to enable a positive draw force.

2. A method as claimed in claim 1 and in which the first stage transversely extending bead means is concavely curved transversely between the first stage slot transverse ends, with the said inclining downward portion of the sheet between the first and second stages being concavely constrained.

3. A method as claimed in claim 2 and in which the edges and width of the sheet taper from its tail end to its head end and the first stage is moved toward the second stage as the sheet is longitudinally drawn through the stages with successively decreasing sheet width, producing a compound curved sector.

4. In a method of drawing sheet metal to form compound curvature sheets in which the drawing is effected by longitudinally drawing the sheet through a first stage having a slot bounded by sheet-restraining transversely extending bead means, longitudinally passing the sheet to a second stage providing a transverse slot and having work-engaging forming elements in longitudinally stepped relation which engage a side of the sheet, and longitudinally passing the sheet over a third stage surface engaging a side of the sheet opposite that engaged by the second stage forming elements, an improvement which obviates wrinkling and rippling of the sheet, comprising the steps of (a) adjusting the first stage slot so that the portion of the sheet bent around the first stage bead means is above the level of the portion of the sheet received in the second stage slot and drawn over its said forming elements, with the sheet portion there-between inclining downwardly between the first and second stages;

(b) clamping a tail end of the sheet with a clamp, prior to said drawing; and (c) sliding the clamp toward the first stage as the sheet is longitudinally drawn successively through the first, second and third stages; and (d) releasing the clamping just before the tail end reaches the first stage;

and in which one or more of the longitudinal spacing between the first and second states, the longitudinal spacing between the third and second stages and the vertical position of the first stage relative to the second stage is varied in a programmed manner to accommodate for one or more of varying sheet dimensions and contouring effects.

5. A method as claimed in claim 4 and in which said varying is effected by servo feedback control.

6. A method as claimed in claim 4 and in which the edges and width of the sheet taper from its tail end to its head end and the first stage is moved toward the second stage as the sheet is longitudinally drawn through the stages with successively decreasing sheet width.

7. In an apparatus for drawing sheet metal to form compound curvature sheets and in which the drawing is effected by longitudinally drawing the sheet through a first stage having a transversely curved slot bounded by sheet-restraining transversely extending bead means, longitudinally passing the sheet to a second stage providing a similarly transversely curved slot and having work-engaging forming elements in longitudinally stepped relation which engage a side of the sheet, and longitudinally passing the sheet over a third stage transversely curved surface engaging the side of the sheet opposite that engaged by the second stage forming elements, an improvement which obviates wrinkling and rippling of the sheet, comprising, in combination, means for mounting the first stage to position its transversely curved slot above the said second stage similarly transversely curved slot; and means for feeding the sheet emerging from the first stage slot somewhat inclinedly downwardly to the second stage slot with means for thence drawing the sheet over said forming elements; and in which jaw-like gripper means are provided extending transversely of the sheet to grip a head end of the sheet prior to drawing, the slide means is provided carrying the gripper means and also shock absorbing means for moving longitudinally away from the third stage to draw the sheet, but with some slippage of the gripper means to accommodate for bringing a drawing motor up to speed before the sheet is actually drawn through the stages.

8. Apparatus as claimed in claim 7 and in which the first, second and third stages engage the sheet along substantially equal radii of curvature and the longitudinal distance between the first and second stages is larger than that between the second and third stages, with the height of the first stage slot above the second stage slot being comparable with the longitudinal distance between the second and third stages.

9. In an apparatus for drawing sheet metal to form compound curvature sheets and in which the drawing is effected by longitudinally drawing the sheet through a first stage having a transversely curved slot bounded by sheet-restraining transversely extending bead means, longitudinally passing the sheet to a second stage providing a similarly transversely curved slot and having work-engaging forming elements in longitudinally stepped relation which engage a side of the sheet, and longitudinally passing the sheet over a third stage transversely curved surface engaging the side of the sheet opposite that engaged by the second stage forming elements, an improvement which obviates wrinkling and rippling of the sheet, comprising, in combination, means for mounting the first stage to position its transversely curved slot above the said second stage similarly transversely curved slot; and means for feeding the sheet emerging from the first stage slot somewhat inclinedly downwardly to the second stage slot with means for thence drawing the sheet over said forming elements; and in which means is provided for varying one or more of the longitudinal spacing between the first and second stages, the longitudinal spacing between the third and second stages and the vertical position of the first stage relative to the second stage in a programmed manner to accommodate for one or more of varying sheet dimensions and contouring effects.

10. Apparatus ad claimed in claim 7 and in which servo feedback means responsive to sheet sensing is provided for effecting such varying.

* * * * *